US005797690A

United States Patent [19]

Iwamura et al.

[11] Patent Number: 5,797,690

[45] Date of Patent: Aug. 25, 1998

[54] PRINTER AND METHOD OF ADJUSTING PRINT DENSITY

[75] Inventors: Eiji Iwamura; Tetsuro Ogino, both of Shizuoka, Japan

[73] Assignee: Star Micronics Co., Ltd., Shizuoka, Japan

[21] Appl. No.: 687,024

[22] Filed: Jul. 25, 1996

[30] Foreign Application Priority Data

Jul. 28, 1995 [JP] Japan ..... 7-193868

[51] Int. Cl.[6] ..... B41J 2/23

[52] U.S. Cl. ..... 400/124.01; 400/53; 400/74; 347/19; 395/108

[58] Field of Search ..... 400/53, 54, 73, 400/74, 82, 149; 347/19; 395/108

[56] References Cited

U.S. PATENT DOCUMENTS

| | | | |
|---|---|---|---|
| 4,576,490 | 3/1986 | Isobe | 400/82 |
| 5,285,220 | 2/1994 | Suzukii et al. | 347/19 |
| 5,481,654 | 1/1996 | Kikuchi et al. | 395/108 |
| 5,519,419 | 5/1996 | Stephany et al. | 400/53 |

FOREIGN PATENT DOCUMENTS

| | | | |
|---|---|---|---|
| 57-072877 | 5/1982 | Japan | 400/53 |
| 61-146544 | 7/1986 | Japan | 400/53 |
| 62-156978 | 7/1987 | Japan | 400/74 |

*Primary Examiner*—David A. Wiecking
*Attorney, Agent, or Firm*—Wenderoth, Lind & Ponack

[57] ABSTRACT

A printer in which print densities of print heads can be adjusted simply and rapidly and set to have an optimum impact force, and a method of adjusting a print density are provided. Concretely, print density patterns which can be set at regular steps toward the high and low density sides of a predetermined density are generated. On the basis of the print density patterns, printing is conducted on a recording medium. A pattern in which a desired print density appears is selected and the print densities of the print heads are absolutely or relatively adjusted.

8 Claims, 9 Drawing Sheets

PRINTER AND METHOD OF ADJUSTING PRINT DENSITY

BACKGROUND OF THE INVENTION

1. Field of the invention

The present invention relates to a printer which is capable of adjusting a print density on a recording medium, and a method of adjusting a print density thereof.

2. Description of the Related Art

A multihead printer having a plurality of print heads which are configured so as to simultaneously conduct printing operations in plural regions into which one line is divided has been developed. Such a printer improves printing operations.

In a usual wire dot type print head, because impact force is changed depending on a time of energizing a coil (hereinafter, such time is referred to as "energizing time"), a technique directed to optimization of the impact force by appropriate adjustment of the energizing time is required.

Even when print heads are driven during the same energizing time, however, impact forces are dispersed in level because of production errors of parts etc..

FIG. 10 is a graph showing dispersion of impact forces of print heads in units of one lot (1,000 heads). In normal print heads, impact forces are dispersed in accordance with a reference normal distribution in symmetry centered at a mean value X. By contrast, in print heads of lot A in which accuracies of parts are biased, for example, distribution of impact forces is centered at a mean value Xa shifted in a direction along which the value becomes smaller than the target value X. In this way, impact forces are distributed in different manners from batch to batch depending on the accuracies of the parts and the assembly accuracies of print heads.

Even in print heads having the same impact force, the impact force is varied by an assembly error caused when the print heads are attached to the main unit of a printer.

Such individual dispersion of impact forces appears as dispersion of print densities on a recording medium. In a multihead printer, particularly, different impact forces of the print heads cause different print densities between print regions, so that an adverse effect on print quality is noticeably produced.

In order to eliminate the variation of print densities in a multihead printer, it may be contemplated that properties of print heads are previously selected and print heads having similar impact forces are mounted on the same printer. However, the selection of an optimum combination from among a number of print heads increases labor and causes an increase in production cost. Consequently, it is preferable to correct the dispersion among print heads of a printer at a step of adjustment operation after the print heads are attached to a printer without conducting the preselection of the print heads. There is a known method of realizing such a countermeasure in which the energizing time of each print head is variable and the respective print heads are adjusted so that uniform impact force is obtained among the print heads.

For example, Japanese Unexamined Patent Publication JP-A 60-240473 (1985) discloses a method in which one standard energizing time is initially set for each print head and test printing is then conducted. When print density variation occurs in a sample print, the print densities are controlled by adjusting the energizing time of one print head so that the print density of the one print head coincides with the print density of another print head. According to the method, it is not required to select print heads in accordance with impact force properties in the process of producing print heads, and hence the production cost of a printer can be reduced.

In the case where readjustment of print density difference is required, for example, in replacement of a print head, however, there may arise the following problems when the readjustment is to be conducted by an general user.

1) Test printing is conducted while changing combinations of preset values of energizing times of the print heads one by one. Thereafter, test printing is conducted again while changing combinations of preset values of energizing times of the print heads one by one. The steps of adjusting energizing times and conducting test printing must be repeated many times. Consequently, such readjustment takes a lot of time and consumes a lot of labor and a large amount of sample prints. Particularly in the case where impact forces are distributed in a wide range as shown in FIG. 10 and a combination of a low-impact print head and a high-impact print head is used, the impact forces are largely different from each other and hence the density adjustment is not easily completed.

2) Even when print density differences among print heads have been corrected as a result of such adjustment works, the print heads are not always adjusted to the optimum condition. The item on which the general user must make a decision is only the print density of a sample print, and it is impossible to judge whether the print heads are adjusted so as to have the optimum impact forces or not. When the print densities of plural print heads are made coincident with a higher print density, for example, excessive energy is supplied to print heads which have produced a lower print density. This may make the power source capacity insufficient and cause an increase in noise level. Furthermore, this may damage a supporting cloth of an ink ribbon and cause the mechanism of the printer to malfunction or the lives of the print heads to be shortened.

In contrast, when the print densities of the plurality of print heads are made coincident with a lower print density, there arises the following problem. The corrected impact force may be sufficient to obtain an appropriate print density on one recording medium, however, in the case of printing on a recording medium in which a plurality of sheets such as pressure sensitive sheets overlap each other, the corrected impact force may be insufficient to obtain an appropriate print density.

As described above, when the print density differences among plural print heads are to be eliminated, the energizing times of the print heads must be adjusted relatively and absolutely. In the prior art, however, this must result in adjustment works which are very complicated and require a great deal of skill.

Japanese Unexamined Patent Publication JP-A 2-178059 (1990) discloses a method in which it is judged whether an energizing time preset in an adjustment work exists within an allowable range or not, and, if the preset energizing time does not exist within the allowable range, the energizing time is ignored, thereby preventing the energizing time from being erroneously adjusted.

According to this method, the energizing time cannot be set to an extremely large or small value and hence an accident due to erroneous adjustment conducted by a general user can be prevented. However, when differences in print density can not be eliminated by this method, it is necessary to readjust the allowable range, and consequently in the method, there arises the same problems as discussed above.

Japanese Unexamined Patent Publication JP-A 6-979 (1994) discloses a method in which, when differences in print density among plural print heads are to be adjusted, a mark sensor disposed in a printer measures print densities of the print heads and, on the basis of the measurement results, a microprocessor calculates an optimum energizing time for each of the print heads, thereby automatically adjusting the print densities.

According to this method, manual adjustment of printing is not required. However, a mark sensor, which is expensive, is necessary in addition to components for the printing function, and accordingly the production cost increases. After a print density adjustment is once completed, further print density adjustments do not frequently follow. Thus, dedicated parts which are less frequently used must be originally mounted on a printer. This is wasteful of resources.

As described above, in the adjusting methods of the prior arts, test printing must be repeated while readjusting energizing times of print heads one by one, and hence the adjusting works are laborious. The method of automatically adjusting energizing times by using a mark sensor causes an increase in production cost.

SUMMARY OF THE INVENTION

It is an object of the invention to provide a printer in which a print density of a print head can be adjusted simply and rapidly and set to have optimum impact forces, and a method of adjusting a print density.

The invention provides a printer comprising:

print density pattern generating means for generating print density patterns which can be set at regular steps toward the high and low density sides of a predetermined reference density; and printing means for printing on a recording medium on the basis of the print density patterns.

According to the invention, print densities which can be set by the printer itself are patterned and the patterns are printed on a recording medium. Therefore, it is possible to judge at a glance whether an appropriate print density is obtained or not. The operator is required only to select a pattern in which a desired print density is obtained and set the printer at a density value corresponding to the selected pattern, resulting in that density adjustment can be completed by one operation. In this way, the print density can be adjusted simply and rapidly.

The invention provides a method of adjusting a print density comprising the steps of:

generating print density patterns which can be set at regular steps toward the high and low density sides of a predetermined reference density; and printing on a recording medium on the basis of the print density patterns by printing means.

According to the invention, the same as described above, since print densities which can be set by a printer itself are patterned and the patterns are printed on a recording medium, it is possible to judge at a glance whether an appropriate print density is obtained or not. The operator is required only to select a pattern in which a desired print density is obtained and set the printer at a density value corresponding to the selected pattern, resulting in that density adjustment can be completed by one operation.

In the invention it is preferable that the printing means includes a plurality of print heads.

According to the invention, in a so-called multihead printer which uses a plurality of print heads and in which split printing is conducted on one line or plural lines are simultaneously subjected to printing, when the print density differences among the print heads are to be eliminated, print densities can be adjusted simply and rapidly by using the above-mentioned print density adjusting method.

Further, in the invention it is preferable that the print density patterns are printed so that a sum of the energizing times of the plurality of print heads is constant.

According to the invention, while the print density patterns are printed, the total of the powers supplied to the print heads is substantially constant irrespective of the kinds of the print density patterns. As compared with the case where all print heads conduct high-density printing, therefore, the power source capacity can be reduced, so that the production cost is reduced.

Further, in the invention it is preferable that each of the print heads is a wire dot type print head including a printing wire and a driving coil, and the print density patterns are printed so that a sum of the energizing times of the print heads is constant.

According to the invention, while the print density patterns are printed, the total of the powers supplied to the print heads is substantially constant irrespective of the kinds of the print density patterns. As compared with the case where all print heads conduct high-density printing, therefore, the power source capacity can be reduced, so that the production cost is reduced.

Further, in the invention it is preferable that the predetermined reference density is arbitrarily adjustable.

According to the invention, print density patterns which can be set at regular steps toward the high and low density sides of the predetermined reference density are printed. By arbitrarily adjusting the predetermined reference density, therefore, the density region of the print density patterns can be adjusted. Consequently, not only relative density adjustment among the print heads, but also absolute density adjustment throughout printing can be conducted.

As described above in detail, according to the invention, print densities which can be set by a printer itself are patterned and the patterns are printed on a recording medium. Therefore, it is possible to judge at a glance whether an appropriate print density is obtained or not. When the operator selects a pattern in which a desired print density is obtained and set the printer at a density value corresponding to the selected pattern, density adjustment can be completed by one operation. In this way, the print density can be adjusted simply and rapidly.

Since the reference density which defines the print density patterns is arbitrarily adjusted, the density region of the print density patterns can be adjusted. Consequently, not only relative density adjustment among the print heads, but also absolute density adjustment throughout printing can be conducted.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
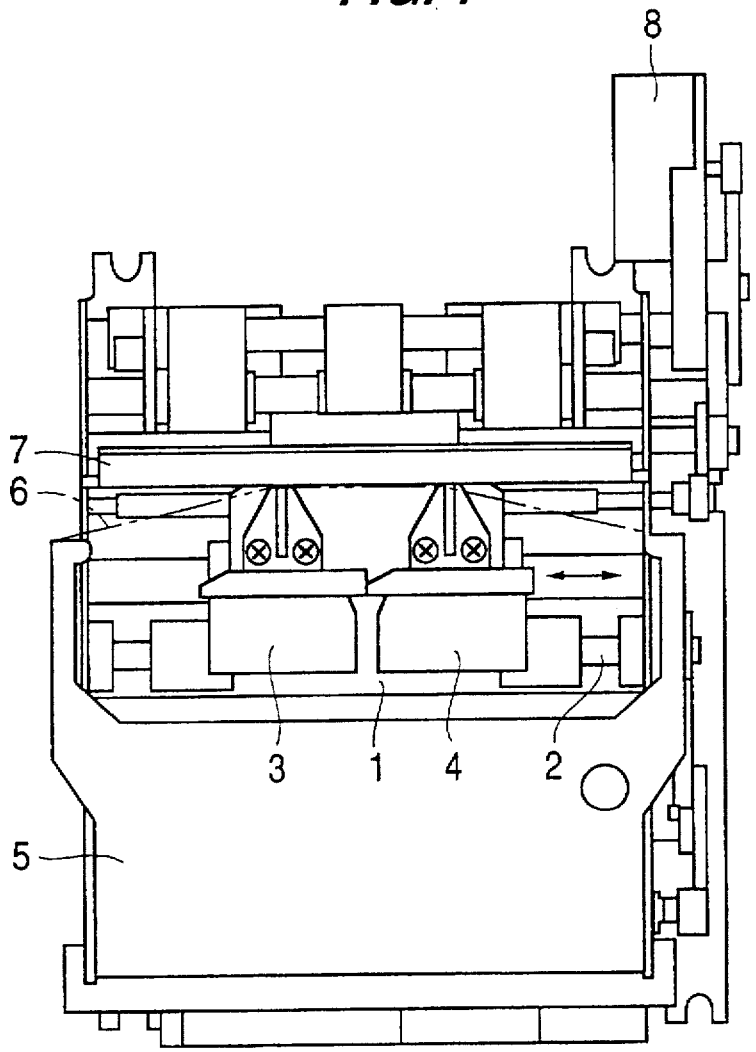
FIG. 1 is a plan view showing the mechanical configuration of an embodiment of the invention.

Now referring to the drawings, preferred embodiments of the invention are described below.

FIG. 1 is a plan view showing the mechanical configuration of an embodiment of the invention. A printer comprises: a carriage 1 which reciprocates along the width direction of a sheet; a drive shaft 2 for driving the carriage 1; two print heads (a left head 3 and a right head 4) which are mounted on the carriage 1; a platen 7 for guiding the sheet; and a PF (Paper Feed) motor 8 for serving as a drive source for transporting the sheet. An ink ribbon 6 is inserted between the platen 7 and the print heads 3 and 4. A ribbon cassette 5 which houses the ink ribbon 6 is attached to the upper face in such a manner that the cassette can be easily attached and detached.

In such a multihead type printer, the left head 3 conducts printing on the left region of the sheet and the right head 4 conducts printing on the right region of the sheet. Therefore, the distance of movement of the carriage 1 is only one half the width of the sheet. Furthermore, the left and right heads 3 and 4 can independently and simultaneously conduct printing in response to separate printing signals, and hence the printing time can be shortened to a value which is about a half that of a printer having a single print head. Alternatively, three or more print heads may be mounted on the carriage 1. In this case, printing speed can be increased in proportion to the increased number of the print heads.

Figure 2:
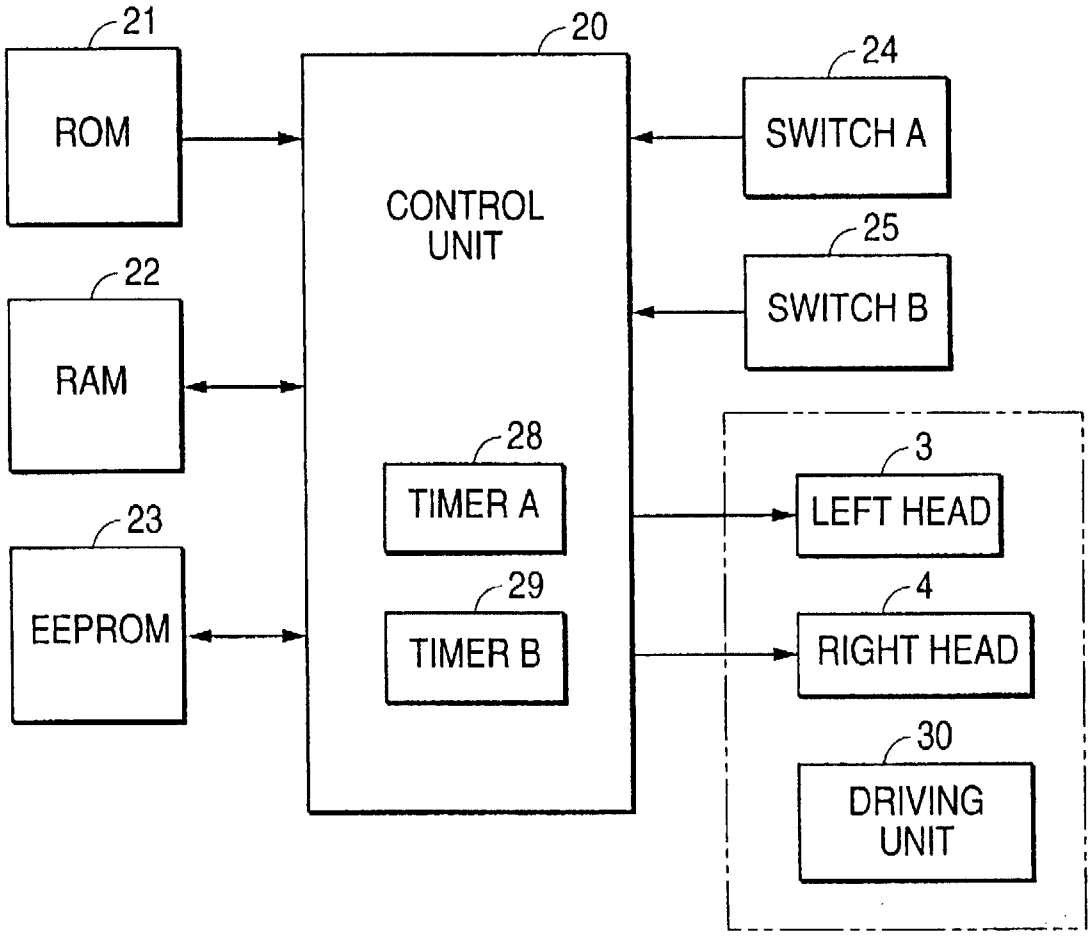
FIG. 2 is a circuit diagram showing the electrical configuration of an embodiment of the invention.

FIG. 2 is a circuit diagram showing the electrical configuration of an embodiment of the invention. The printer comprises: a control unit 20 composed of a CPU (Central Processing Unit) and a gate array, for controlling operations of the whole printer; a ROM (Read-Only Memory) 21 for storing programs and data; a rewritable RAM (Random Access Memory) 22 for storing programs and data; a rewritable and nonvolatile EEPROM (Electrically Erasable Programmable ROM) 23; a switch A 24 for giving an instruction about sheet feed operation; a switch B 25 for placing a host apparatus online or offline; and a driving unit 30 for driving a print mechanism.

In the control unit 20, incorporated are a timer A 28 for setting the energizing time of the left head 3, and a timer B 29 for setting the energizing time of the right head 4. In a wire dot type print head, the print density depends on an energizing time of the print head. When the print density is to be increased, therefore, the timer set value is increased, and, when the print density is to be reduced, the timer set value is reduced.

Figure 3:
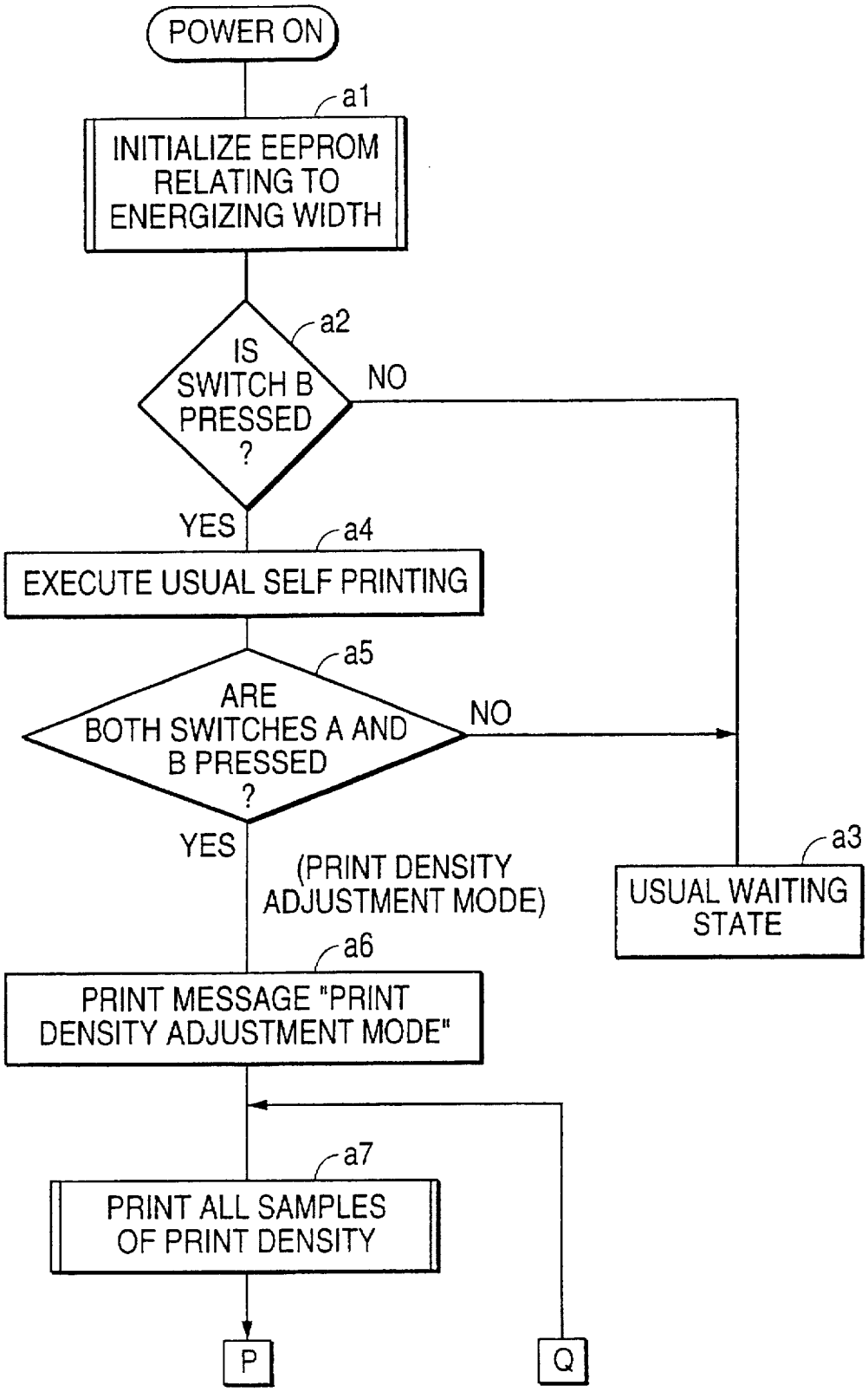
FIG. 3 is a main flowchart showing an operation of the invention.

FIGS. 3 to 8 are flowcharts showing the operations in relation to the invention. Referring to FIG. 3, when the printer is powered on, an initialization routine of the EEPROM 23 relating to the energizing width (energizing time) is executed at step a1.

Figure 5:
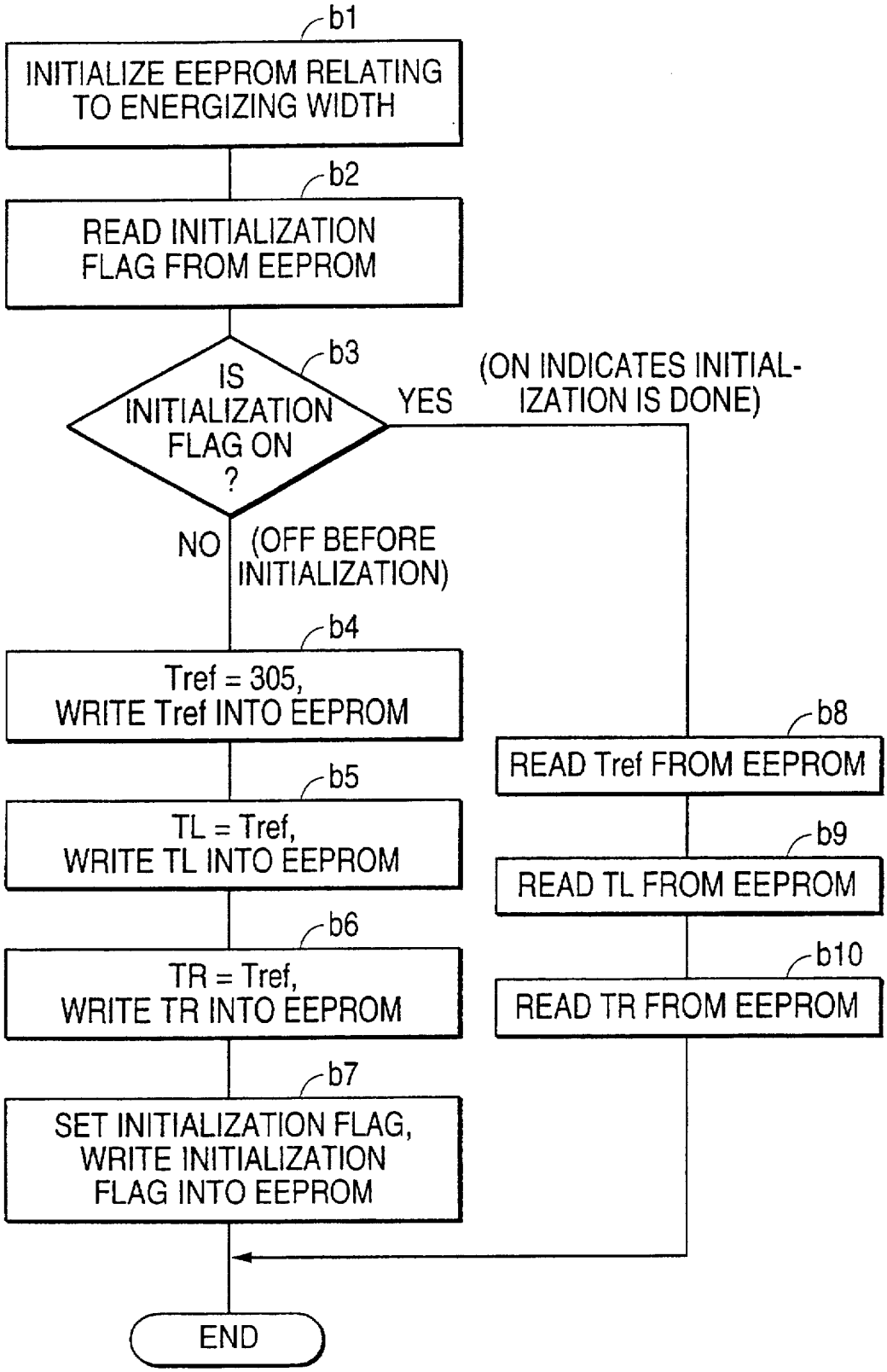
FIG. 5 is a flowchart showing an initialization routine of an EEPROM 23.

FIG. 5 is a flowchart showing the initialization routine of the EEPROM 23. Processing starts from step b1, an initialization flag is read out at step b2 from the EEPROM 23, and the initialization flag is judged at step b3. If no initial value is set, the initialization flag is off, and the process proceeds to step b4 where a reference energizing time Tref is initialized to a value of 305 (μ sec.) which is stored in the ROM 21 and then written into the EEPROM 23. At steps b5 and b6, an energizing time TL of the left head 3 and an energizing time TR of the right head 4 are initialized to the same value as the reference Tref and then written into the EEPROM 23. At step b7, in order to store the termination of the initialization, the initialization flag is set to on and then written into the EEPROM 23. Thereafter, the routine is ended.

On the other hand, if steps b4 to b7 have been once executed, the initialization flag is judged at step b3 to be on, and the process proceeds to step b8. At steps b8 to b10, the reference energizing time Tref, the energizing time TL of the left head 3, and the energizing time TR of the right head 4 are read out from the EEPROM 23, and this routine is ended. The memory location for the reference Tref is reserved in the RAM 22, the energizing time TL is stored in the timer A 28, and the energizing time TR is stored in the timer B 29.

Returning to FIG. 3, it is judged at next step a2 whether, when the printer is powered on, the switch B 25 is pressed or not. If the switch is not pressed, the process proceeds to step a3 to enter the waiting state of a usual printing operation. If the switch B 25 is pressed, usual self printing, i.e., test printing of numerals, ASCII characters, symbols, etc. is executed.

Figure 9A:
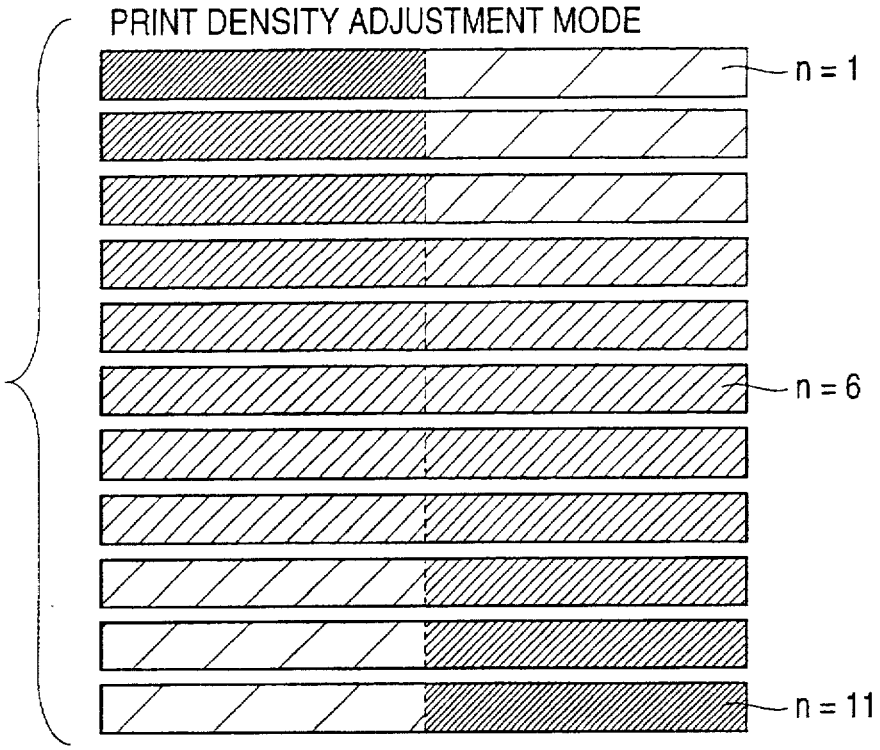
FIG. 9A shows an example of printing of all print density samples.

If, when the printer is powered on, both the switch A 24 and the switch B 25 are pressed, the process proceeds from step a5 to step a6 to enter a print density adjustment mode. At step a6, characters "PRINT DENSITY ADJUSTMENT MODE" are printed. Thereafter, all samples for print density adjustment are printed at step a7. FIG. 9A shows an example of the print samples.

Figure 6:
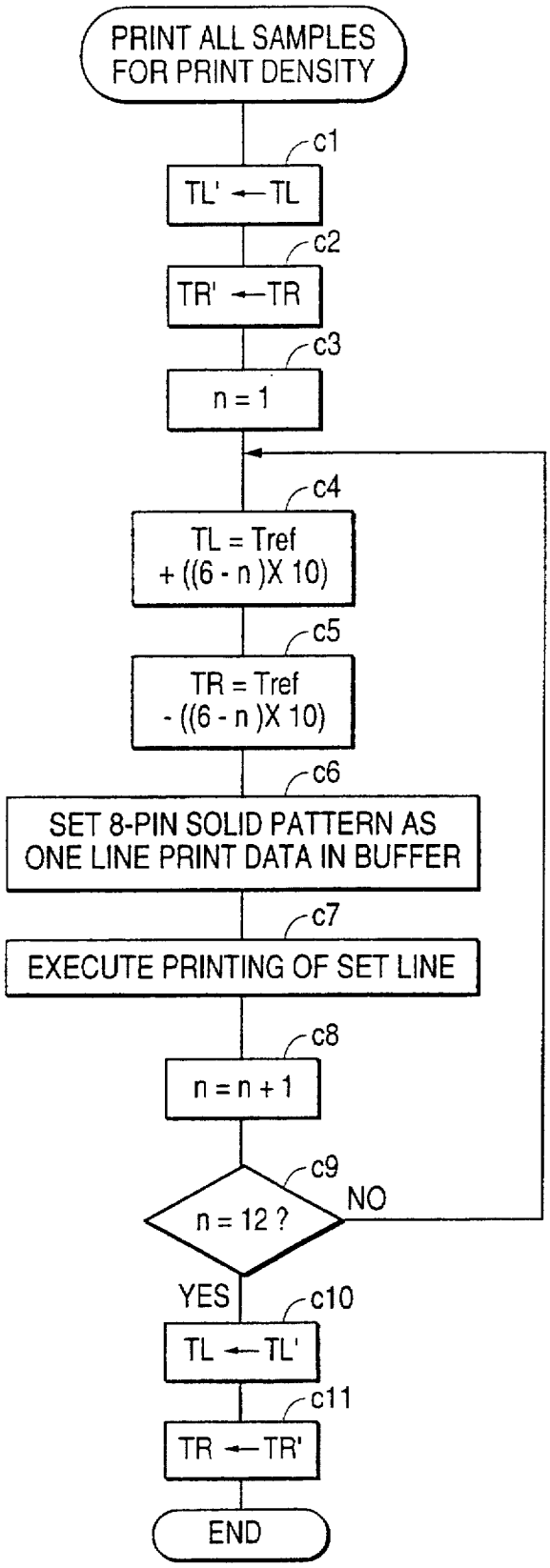
FIG. 6 is a flowchart showing a routine of printing of all print density samples at step a7.

FIG. 6 is a flowchart showing a routine of printing all print density samples at step a7. At steps c1 and c2, the energizing times TL and TR stored in the timers A 28 and B 29 are transferred to variables TL' and TR' in order to temporarily save the energizing times TL and TR. At next step c3, a variable n is set to 1 (n=1). The energizing time TL is rewritten at step c4 to TL=reference Tref+((6−n)×10), and the energizing time TR is rewritten at step c5 to TR=reference Tref−((6−n)×10). When n=1, for example, TL=305+5×10=355 and TL=305−5×10=255.

At next step c6, a solid print pattern which is to be generated by all the pins of each print head, for example, 8 pins is generated as print data, and one line data are set in a print buffer. Printing is executed at step c7 on the basis of the data of solid printing which are set in the print buffer. At this time, the left head 3 conducts printing on the left region of the one line in accordance with the energizing time TL, and the right head 4 conducts printing on the right region of the one line in accordance with the energizing time TR. When n=1, for example, the left region is subjected to printing in accordance with the energizing time TL=355 (μ sec.) and the right region is subjected to printing in accordance with the energizing time TR=255 (μ sec.). Therefore, the print density of the left region is high and that of the right region is low.

Next, n is incremented at step c8 by 1. The loop of steps c4 to c8 is repeated until n is judged at step c9 to reach 12.

As a result, a sample print on which a print density pattern is recorded is obtained. In the print density pattern, as shown in FIG. 9A, the left region is stepwise changed from a high density to a low density and the right region is stepwise changed from a low density to a high density. Table 1 lists energizing times of the left and right heads corresponding to the print density patterns of FIG. 9A.

TABLE 1

| Print line | Energizing time of left head (μs) | Energizing time of right head (μs) |
|---|---|---|
| n = 1 | 355 | 255 |
| 2 | 345 | 265 |
| 3 | 335 | 275 |
| 4 | 325 | 285 |
| 5 | 315 | 295 |
| 6 | 305 | 305 |
| 7 | 295 | 315 |
| 8 | 285 | 325 |
| 9 | 275 | 335 |
| 10 | 265 | 345 |
| 11 | 255 | 355 |

When n=6, printing is conducted with setting both the energizing times TL and TR to 305 (μ sec.). If the impact force of the left head 3 is equal to that of the right head 4, the same print density is obtained in both regions.

In such a print density pattern, it is preferable to conduct printing so that the sum of the energizing times of the left and right heads is constant. According to this configuration, the total of the powers supplied to the print heads is substantially constant at any time. As compared with the case where all print heads conduct high-density printing, therefore, the power source capacity can be reduced and an increase in production cost is prevented.

When the impact force of the left head 3 is different from that of the right head 4, a print line in which there is no difference in print density between the left and right halves appears with being shifted upward or downward from the center (n=6). The user observes in which print line the density difference between the left and right halves disappears. Thereafter, the user proceeds to a density adjustment operation.

At steps c10 and c11, the energizing times TL and TR which have been temporarily saved at steps c1 and c2 are returned to the timers A 28 and B 29. Thereafter, the routine is ended.

Figure 4:
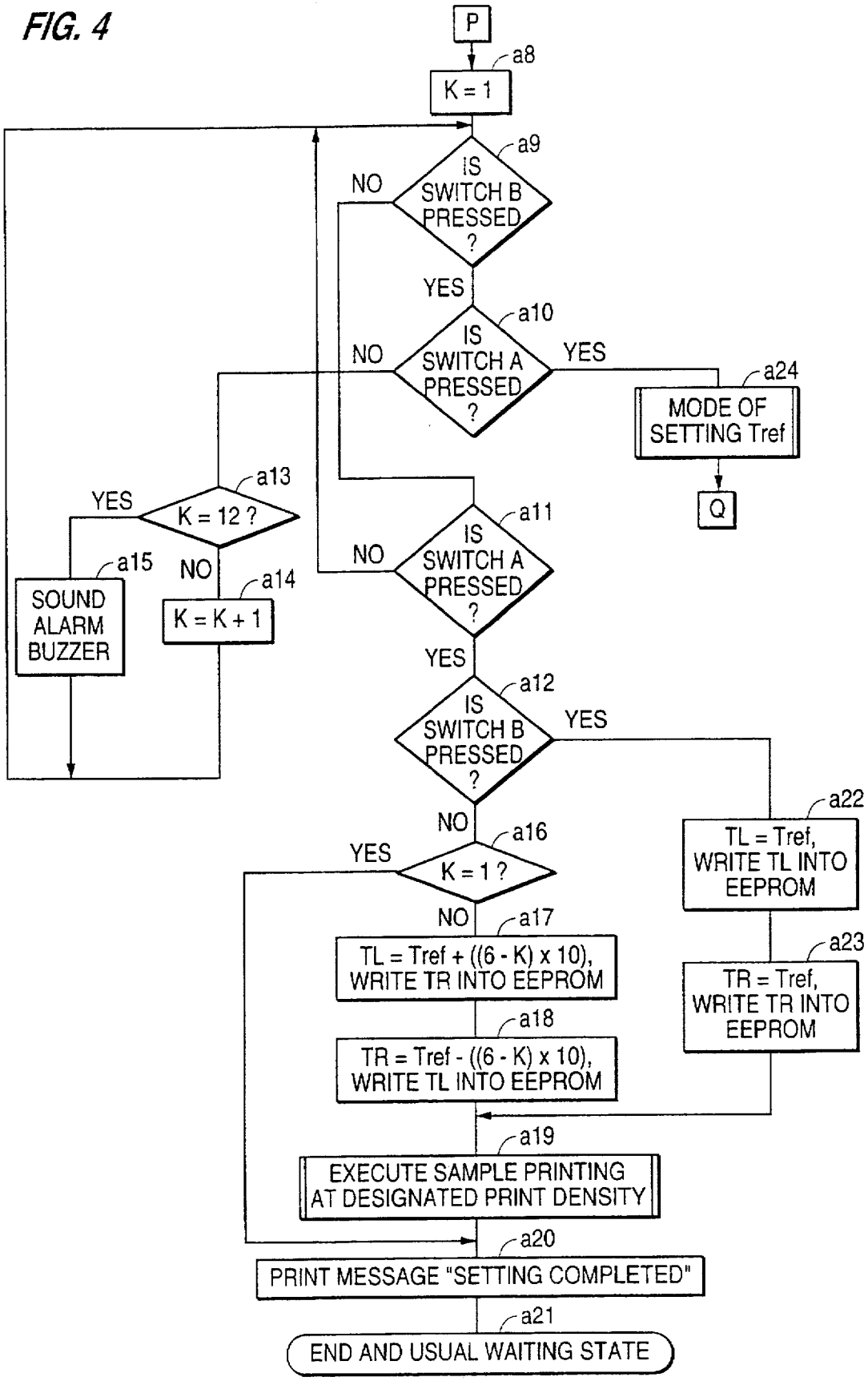
FIG. 4 is another main flowchart showing an operation of the invention.

The process proceeds from FIG. 3 to FIG. 4. At step a8, a variable K is set to 1. At steps a9 to a12, it is judged which one of the switches B 25 and A 24 is pressed and in what sequence the switches are pressed.

If only the switch B 25 is pressed, the process proceeds to step a13 where it is judged whether K=12 or not, and then enters a loop where K is incremented at step a14 by 1 and the process returns to step a9. This loop is a routine in which the number of operations of pressing the switch A 24 is stored as the value of K. When the variable K reaches 12, an alarm buzzer is sounded at step a15 to inform the user that the variable K is set to the maximum value of 12. During this loop, the user observes the print density pattern shown in FIG. 9A and sets the line number of the print line which the user judges to have no print density difference between the left and right halves, as the value of K.

If only the switch A 24 is pressed at steps a9 to a12, the process proceeds to step a16 to judge whether the variable K which has been set in the above-mentioned loop is 1 or not. If K remains 1, the process skips to step a20, where characters "SETTING COMPLETED" are printed on the sheet, and at step a21 the process returns to the waiting state of the usual printing operation.

If K≠1, the process proceeds to steps a17 and a18. The energizing time TL set in the timer A 28 is rewritten to reference Tref+((6−K)×10), and the energizing time TR set in the timer B 29 is rewritten to reference Tref−((6−K)×10), and also the contents which respectively correspond to TL and TR and are stored in the EEPROM 23 are rewritten. In this way, the print densities of the left and right halves can be made coincident with each other by independently setting the energizing times of the left and right heads 3 and 4.

Figure 9B:
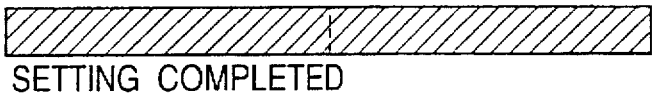
FIG. 9B shows an example of sample printing after adjustment.
Figure 10:
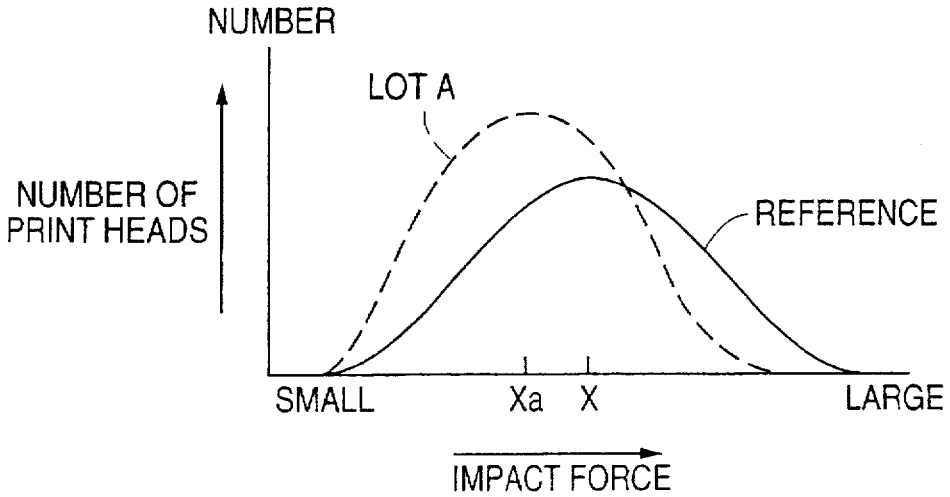
FIG. 10 is a graph showing dispersion of impact forces of print heads.

In order to confirm that the print density difference is actually eliminated, test printing for only one line is executed at step a19 on the basis of the new energizing times TL and TR, so as to produce a sample print such as shown in FIG. 9B.

Figure 7:
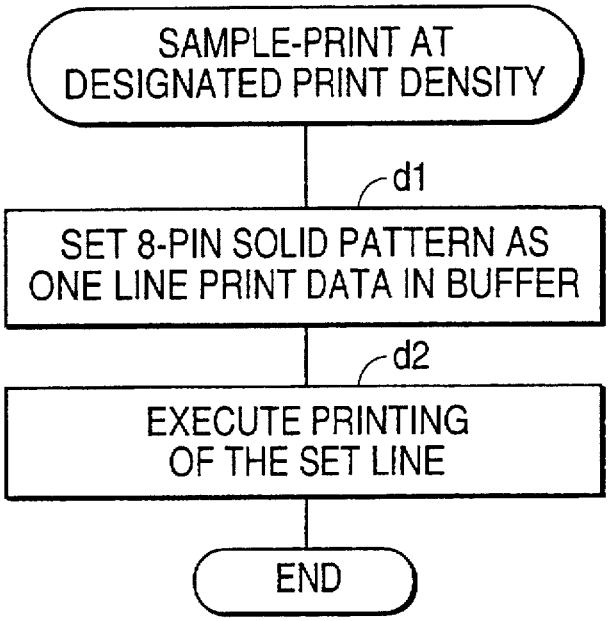
FIG. 7 is a flowchart showing a routine at step a19.

FIG. 7 is a flowchart showing a routine of step a19. At steps d1 and d2, in the same manner as steps c6 and c7 of FIG. 6, solid printing is executed, or specifically a solid print pattern which is to be generated by 8 pins of each print head is generated. Also in this case, the left head 3 conducts printing on the left region of the one line in accordance with the energizing time TL, and the right head 4 conducts printing on the right region of the one line in accordance with the energizing time TR. When it is judged that the density difference disappears in the seventh print line, for example, K is set to 7. In this case, the test printing is conducted on the base of the energizing time TL=315 and the energizing time TR=295, and as shown in FIG. 9B, it is confirmed whether the print density difference between the left and right halves is eliminated or not. Thereafter, characters "SETTING COMPLETED" are printed at step a20 and at step a21 the process returns to the waiting state of the usual printing operation.

By contrast, at steps a9 to a12, if the switch B 25 is pressed under the state that the switch A 24 is pressed, the process is transferred to steps a22 and a23 where the left and right energizing times TL and TR are reset to the reference Tref, and the contents stored in the EEPROM 23 are rewritten. In this routine, the energizing times TL and TR are returned to the initial values. Thereafter, the process proceeds to step a19 where the test printing of one line is executed and the contents of the setting are reconfirmed.

When at steps a9 to a12 the switch A 24 is pressed under the state that the switch B 25 is pressed, the process proceeds to step a24 which is a mode of setting the reference Tref.

Figure 8:
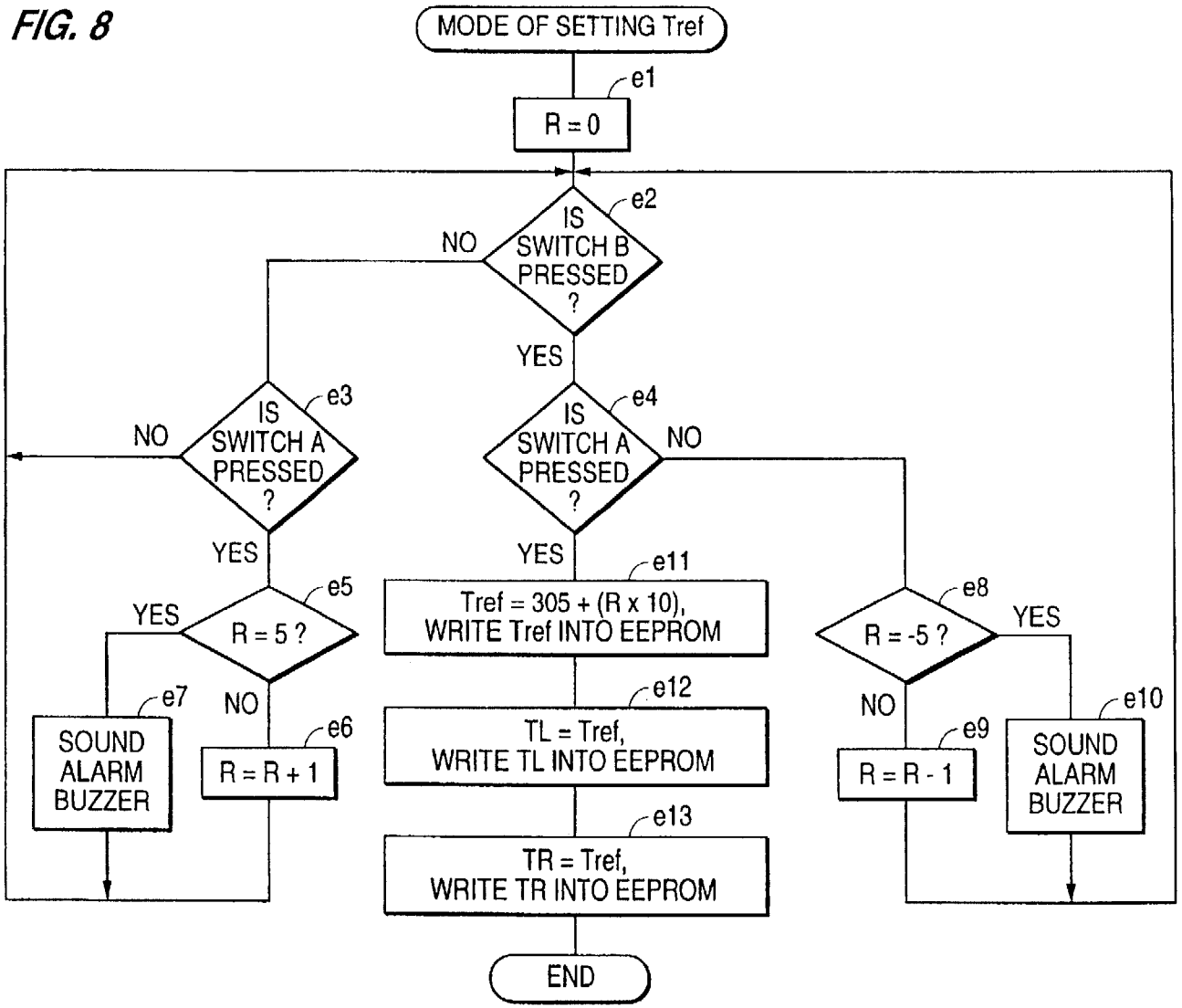
FIG. 8 is a flowchart showing a routine at step a24 which is a mode of setting a reference Tref.

FIG. 8 is a flowchart showing a routine of step a24 which is a mode of setting the reference Tref. At step e1, a variable R is set to 0. Thereafter, the process proceeds to judgment on the switches A and B. When only the switch A 24 is pressed at steps e2 to e4, the process enters a loop consisting of judgment at step e5 of whether R=5 or not, increment of R at step e6, and activation of the alarm buzzer at step e7. The number of operations of pressing the switch A 24 is added to the variable R.

When only the switch B 25 is pressed at steps e2 to e4, the process similarly enters a loop consisting of judgment at step e8 of whether R=−5 or not, decrement of R at step e9, and activation of the alarm buzzer at step e10. The number of operations of pressing the switch B 25 is subtracted from the variable R.

When at steps e2 to e4 the switch A 24 is pressed under the state where the switch B 25 is pressed, the following rewriting operations are conducted at steps e11 to e13. The reference Tref is rewritten to the value of 305+(R×10), the energizing time TL set in the timer A 28 is rewritten to the new reference Tref, the energizing time TR set in the timer B 29 is rewritten to the new reference Tref, and also the contents which respectively correspond to Tref, TL and TR and are stored in the EEPROM 23 are rewritten. Thereafter, the routine is ended.

In this way, when the energizing times of the left and right heads 3 and 4 are to be adjusted, the density reference which functions as the reference of the absolute density can be arbitrarily set. This allows the density range of the print density pattern to be adjusted, with the result that not only the relative density adjustment among the print heads, but also the absolute density adjustment of the whole of the sample print can be conducted.

In the above description, an example in which the energizing time defining the print density pattern is changed at steps of 10 (μ sec.) has been described. Alternatively, the time step may have another value such as 1 (μ sec.) or 20 (μ sec.), or the time steps of the respective print lines may be unequal to each other.

The upper and lower limits of the energizing time should be determined depending on the properties of the print heads, and are not restricted to the values used in the above description.

In the above, an example of a wire dot type print head has been described. The invention may be applied to a print head of another type such as thermal head type or ink Jet type.

In the above, an example of a multihead printer in which two heads or left and right heads are used has been described. The invention may be applied to a printer on which three or more print heads are mounted.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of adjusting a print density comprising the steps of:

generating print density patterns which can be set at regular steps toward the high and low density sides of a predetermined reference density; and printing on a recording medium on the basis of the print density patterns by printing means;

wherein the printing means includes a plurality of print heads, and wherein the print density patterns are printed so that a sum of the energizing times of the plurality of print heads is constant.

2. A method of adjusting a print density comprising the steps of:

generating print density patterns which can be set at regular steps toward the high and low density sides of a predetermined reference density; and printing on a recording medium on the basis of the print density patterns by printing means;

wherein the printing means includes a plurality of print heads, and wherein each of the print heads is a wire dot type print head including a printing wire and a driving coil, and the print density patterns are printed so that a sum of the energizing times of the print heads is constant.

3. A method of adjusting a print density comprising the steps of:

generating print density patterns which can be set at regular steps toward the high and low density sides of a predetermined reference density;

sequentially printing a plurality of sample print patterns of different print densities on one or plural recording mediums by printing means on the basis of the plurality of print density patterns;

selecting a sample print pattern of a desired print density from among the plurality of sample print patterns; and setting a print density corresponding to the selected pattern.

4. The method of adjusting a print density of claim 3, wherein the printing means includes a plurality of print heads.

5. The method of adjusting a print density of claim 4, wherein the print density patterns are printed so that a sum of the energizing times of the plurality of print heads is constant.

6. The method of adjusting a print density of claim 4, wherein each of the print heads is a wire dot type print head including a printing wire and a driving coil, and the print density patterns are printed so that a sum of the energizing times of the print heads is constant.

7. The method of adjusting a print density of claim 3, wherein the predetermined reference density is arbitrarily adjustable.

8. A printer comprising:

print density pattern generating means for generating print density patterns which can be set at regular steps toward the high and low density sides of a predetermined reference density;

print density adjusting mode setting means for changing a mode of the printer from a normal printing mode to a print density adjusting mode; and printing means for printing on a recording mediums wherein print patterns of different print densities are sequentially printed on the recording medium on the basis of the plurality of print density patterns.

* * * * *